US008161881B2

(12) United States Patent
Brooks et al.

(10) Patent No.: US 8,161,881 B2
(45) Date of Patent: Apr. 24, 2012

(54) RING BOOSTER FOR FUZE

(75) Inventors: George W. Brooks, Orlando, FL (US); Daniel J. Martorana, Winter Park, FL (US); Jacob A. Diez, Orlando, FL (US); David Falabella, Merritt Island, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 342 days.

(21) Appl. No.: 12/388,149

(22) Filed: Feb. 18, 2009

(65) Prior Publication Data

US 2009/0205527 A1 Aug. 20, 2009

Related U.S. Application Data

(60) Provisional application No. 61/029,435, filed on Feb. 18, 2008.

(51) Int. Cl.
*C06C 5/04* (2006.01)

(52) U.S. Cl. ..... 102/275.9

(58) Field of Classification Search ..... 102/275.9, 102/275.12, 275.11, 275.2, 275.14, 305, 102/306
See application file for complete search history.

(56) References Cited

U.S. PATENT DOCUMENTS

| | | | | |
|---|---|---|---|---|
| 2,360,698 | A * | 10/1944 | Lyte | 102/202.11 |
| 3,937,143 | A * | 2/1976 | Schlueter | 102/275.9 |
| 3,978,791 | A * | 9/1976 | Lemley et al. | 102/202.14 |
| 4,574,702 | A | 3/1986 | Brandt | |
| 6,105,505 | A | 8/2000 | Jones | |
| 6,276,277 | B1 | 8/2001 | Schmacker | |
| 7,752,972 | B1 * | 7/2010 | Baker et al. | 102/309 |
| 2003/0140811 | A1 | 7/2003 | Bone | |

* cited by examiner

*Primary Examiner* — Bret Hayes
*Assistant Examiner* — Reginald Tillman, Jr.
(74) *Attorney, Agent, or Firm* — Jeffrey D. Myers; Justin R. Jackson; Timothy D. Stanley

(57) ABSTRACT

A fuse and a fusing method comprising initiating detonation of a first booster comprising a circular shaped charge and thereby causing detonation of a second booster.

18 Claims, 5 Drawing Sheets

RING BOOSTER FOR FUZE

CROSS-REFERENCE TO RELATED APPLICATIONS

This application claims priority to and the benefit of the filing of U.S. Provisional Patent Application Ser. No. 61/029,435, entitled "Ring Booster for Fuze", filed on Feb. 18, 2008, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to boosters for fuzes.

2. Description of Related Art

Current booster designs for fuzes are configured to provide axial and/or radial initiation of main explosive charges. A fuze design that will survive the environment of hard target penetration (with protective shock absorbing/encapsulating shroud) cannot reliably initiate the main charge when an axial FZU (Fuzing Unit) power connection is required in the explosive train design. The present invention provides a solution for this problem.

A typical prior art fuzing configuration 10 is shown in FIG. 1, comprising fuze/fuze well/fuze retainers 12 (e.g., comprising 0.11" thickness steel), isolator material 14 (e.g., comprising 0.365" thickness polyrubber), fuze cases 18 (e.g., of 0.11" thickness stainless steel), first booster 16 (e.g., 1.8" diameter explosive material), and second booster 20 (e.g., 2.42" diameter explosive material).

BRIEF SUMMARY OF THE INVENTION

The present invention comprises a fuze and a fuzing method comprising: initiating detonation of a first booster comprising a circular shaped charge; and thereby causing detonation of a second booster. In the preferred embodiment, the first booster comprises a central conical portion surrounded by a raised ring. A detonation shaper is employed between the boosters, preferably conforming substantially to the shape of the first booster and/or comprising copper and/or molybdenum. The first booster preferably comprises PBXN-5 explosive, and the second booster PBXN-9 explosive. The second booster can comprise a central void, most preferably sized to permit passage of a FZU power connection therethrough. Alternatively, the second booster can comprise no voids and/or an insensitive, shock resistant, explosive.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a fuze, a method of making a fuze, and a fuzing method preferably for hard target penetrators. The fuze of the invention survives the penetration and perforation of hard (reinforced concrete) targets and functions in particular with respect to voids deep beneath these targets, e.g., rooms protected by many feet of reinforced concrete. Although the explosive train caused by the invention will reliably initiate the solid booster and main charge of the penetrator, the fuze design is preferably usable with current penetrators which utilize a power source known as an "FZU" which connects to the front of the fuze. To enable this connection to be made, the second booster preferably has a central void area for the FZU connection. These configurations cannot be reliably initiated with standard booster configurations, as the first booster output is not sufficient to both perforate the isolation material and cause high order detonation of the second booster (with the center void) and the main charge.

The fuze of the invention preferably has at least two boosters, most preferably two. The output of the first booster must project the detonation wave through the protective material and into the second booster at sufficiently high levels to detonate the second booster and main charge. With the centerline void area for the FZU connection, the major portion of the first booster output, whether with conventional or flyer-plate output as found in conventional booster designs, has reduced capability to initiate the second booster and the main charge. The invention provides a novel output for the first booster in the form of a ring-shaped Circular Shaped Charge which will focus the output toward the circular-shaped second booster, focusing and concentrating the detonation output of the first booster into the second booster after passing through the isolation material. Calculations using CTH hydro code indicate that effective initiation of the second booster and main charge is achieved with this unique configuration. This approach is also useful with the HTVSF (Hard Target Void Sensing Fuze).

Figure 1:
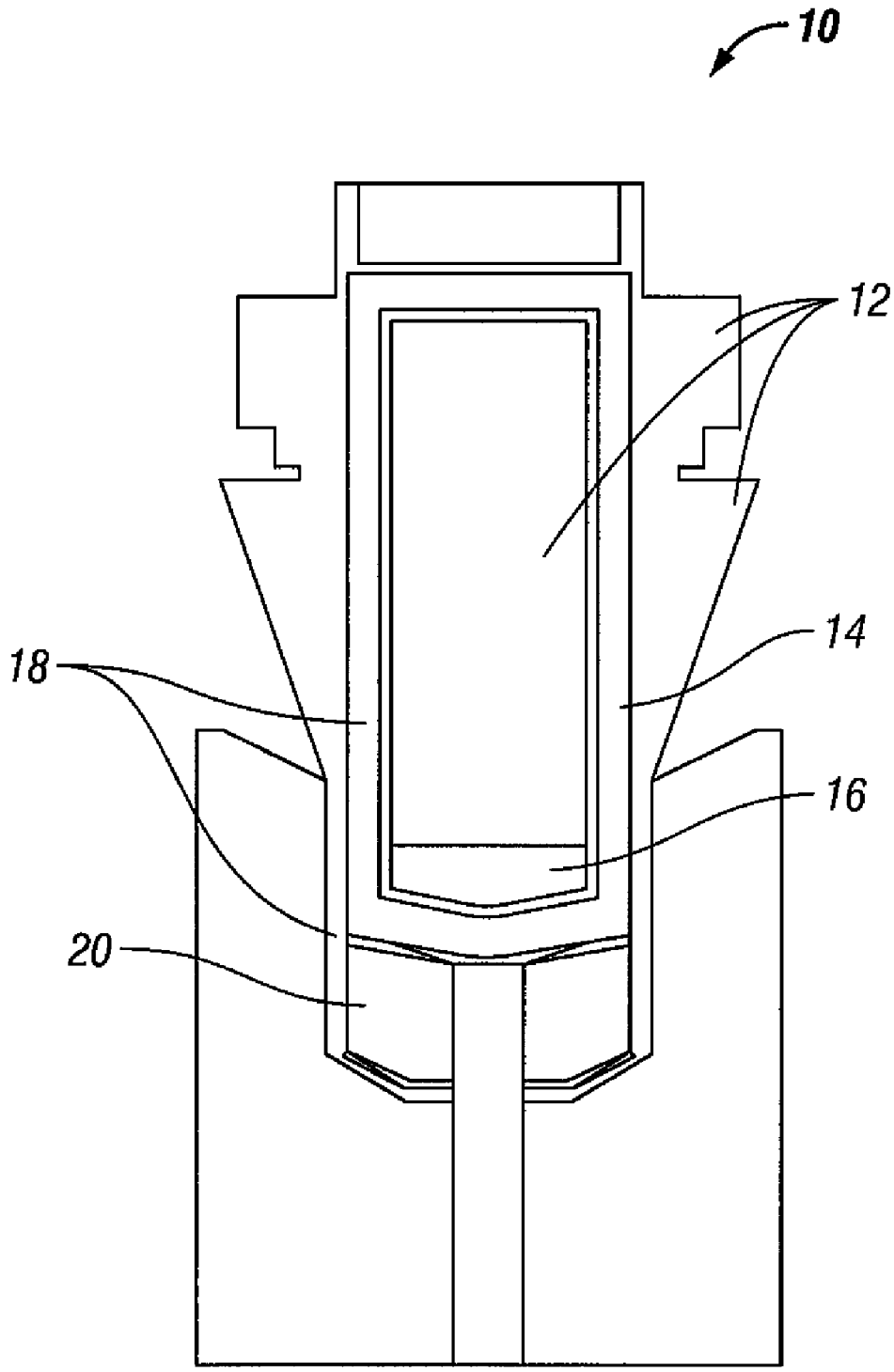
FIG. 1 (Prior Art)
FIG. 1 is a cutaway view of a prior art explosive device with two boosters for the fuze.
Figure 2:
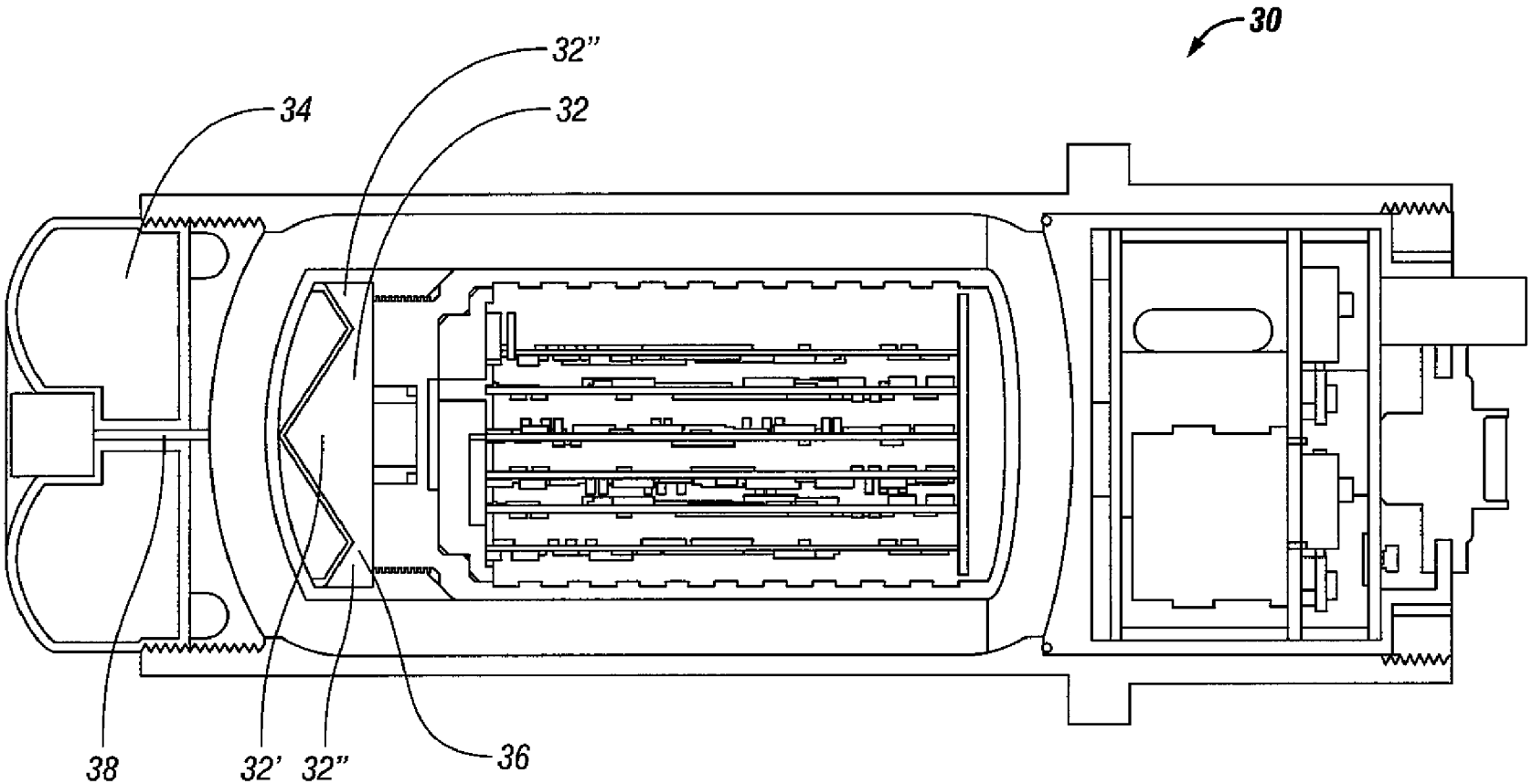
FIG. 2 is a cutaway view of the booster configuration according to the invention.

FIG. 2 illustrates the preferred device 30 of the invention, comprising first booster 32, second booster 34 (with central void with FZU power connection 38), and detonation shaper 36. The first booster preferably has a central conical portion 32' surrounded by a raised ring 32", as illustrated. The detonation shaper preferably corresponds in shape to the first booster, and preferably comprises copper, molybdenum, or other shaped charge liner material. The first booster can be any appropriate fuzing explosive, but preferably comprises PBXN-5 explosive. Similarly, the second booster can be any appropriate fuzing explosive, but preferably comprises PBXN-9 explosive.

Figure 3:
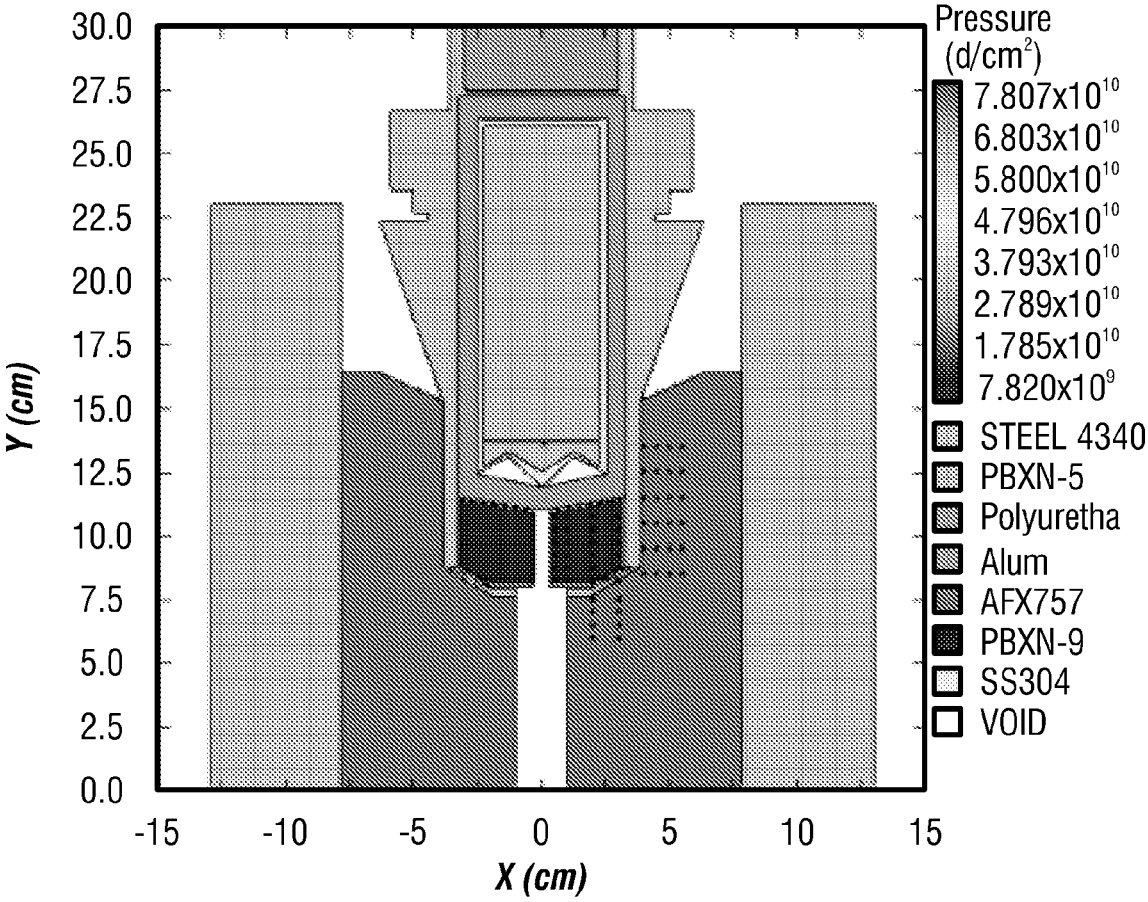
FIG. 3 provides simulation results for the device of FIG. 2 at time zero.
Figure 4:
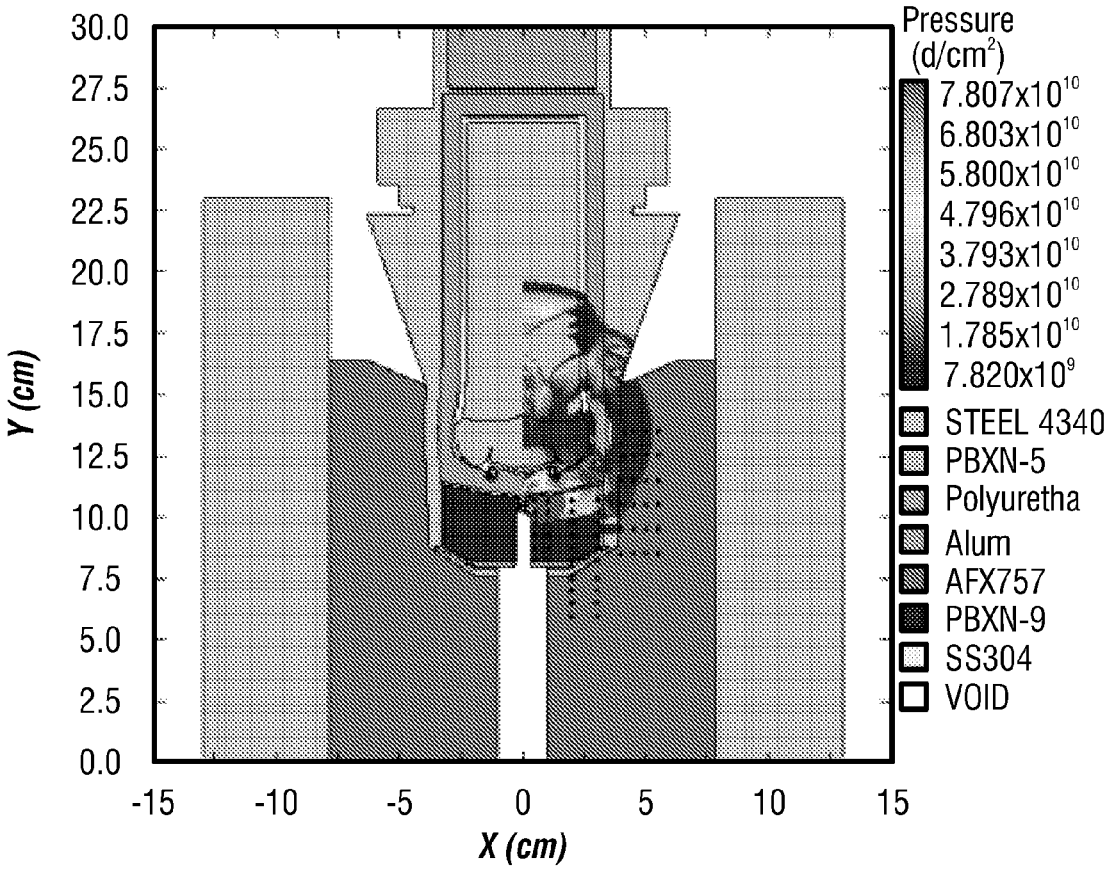
FIG. 4 provides simulation results for the device of FIG. 2 at about time $1.2\times10^{-5}$ sec.
Figure 5:
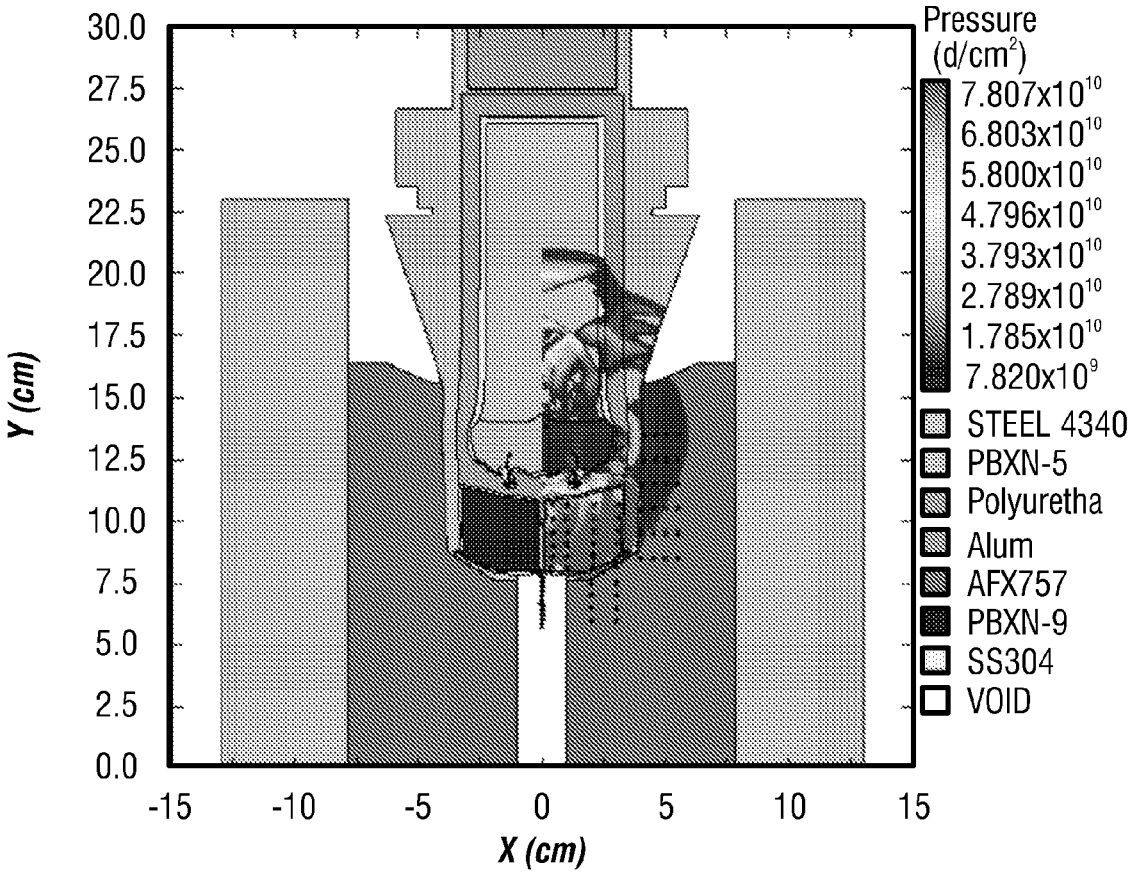
FIG. 5 provides simulation results for the device of FIG. 2 at about time $1.5\times10^{-5}$ sec.

As shown in FIGS. 3-5, CTH hydrocode (Sandia National Laboratories) modeling of the invention of FIG. 2 utilizing the circular shaped charge booster output indicates adequate shock margin for successful high order initiation of the main charge.

The present invention enables utilization of the fuze in penetrators requiring forward axial FZU connections which would not otherwise be viable weapons. The cost of implementing the new design is minimal, and there is no volume or weight increase. For penetrators having protective shrouds around the fuze and first booster, but not employing a FZU as the power source, the second booster does not require a hole through the axis and also functions better with the shaped first booster output according to the invention. Other shapes such as shallow cones are possible as well. While the preferred embodiment of the invention is directed to a fuze employed with projectiles designed to penetrate hard and/or deeply buried targets, the invention is also useful in fuzes of any sort. A further application of the shaped booster output of the invention is for initiation of insensitive (shock resistant) explosives because reduced sensitivity explosive fills what would otherwise require an unnecessarily large booster to initiate.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A fuze comprising:

a first booster comprising a circular shaped charge, wherein said first booster comprises a central conical portion surrounded by a concave disc portion, said concave disc portion surrounded by a raised ring;

a second booster initiated by said first booster; and a detonation shaper between said boosters, wherein said detonation shaper conforms substantially to the shape of said first booster.

2. The fuze of claim 1 wherein said detonation shaper comprises one or more materials selected from the group consisting of copper and molybdenum.

3. The fuze of claim 1 wherein said first booster comprises PBXN-5 explosive.

4. The fuze of claim 3 wherein said second booster comprises PBXN-9 explosive.

5. The fuze of claim 1 wherein said second booster comprises PBXN-9 explosive.

6. The fuze of claim 1 wherein said second booster comprises a central void.

7. The fuze of claim 6 wherein said central void is sized to permit passage of a fuzing unit power connection therethrough.

8. A fuzing method comprising the steps of:

initiating detonation of a first booster comprising a circular shaped charge, wherein the first booster comprises a central conical portion surrounded by a raised ring thereby forming a v-shaped channel in said first booster; and thereby causing detonation of a second booster; and wherein in the causing step the causing of the detonation occurs through a detonation shaper between the boosters, wherein the detonation shaper corresponds substantially to the shape of the first booster.

9. The method of claim 8 wherein the detonation shaper comprises one or more materials selected from the group consisting of copper and molybdenum.

10. The method of claim 8 wherein the first booster comprises PBXN-5 explosive.

11. The method of claim 10 wherein the second booster comprises PBXN-9 explosive.

12. The method of claim 8 wherein the second booster comprises PBXN-9 explosive.

13. The method of claim 8 wherein the second booster comprises a central void.

14. The method of claim 13 wherein the central void is sized to permit passage of a fuzing unit power connection therethrough.

15. The method of claim 8 wherein the second booster comprises no voids.

16. The method of claim 8 wherein the second booster comprises a shock resistant explosive.

17. A fuze comprising:

a first booster comprising a circular shaped charge, wherein said first booster comprises a central conical portion surrounded by a raised ring, thereby forming a v-shaped channel in said first booster;

a second booster initiated by said first booster; and a detonation shaper between said boosters, wherein said detonation shaper conforms substantially to the shape of said first booster.

18. A fuzing method comprising the steps of:

initiating detonation of a first booster comprising a circular shaped charge, wherein the first booster comprises a central conical portion surrounded by a concave disc portion, said concave portion surrounded by a raised ring; and thereby causing detonation of a second booster; and wherein in the causing step the causing of the detonation occurs through a detonation shaper between the boosters, wherein the detonation shaper corresponds substantially to the shape of the first booster.

* * * * *